US005804821A

United States Patent [19]

Nakagawa

[11] Patent Number: 5,804,821

[45] Date of Patent: Sep. 8, 1998

[54] PLASMA ION SOURCE MASS ANALYZER

[75] Inventor: Yoshitomo Nakagawa, Chiba, Japan

[73] Assignee: Seiko Instruments Inc., Chiba, Japan

[21] Appl. No.: 856,605

[22] Filed: May 15, 1997

[30] Foreign Application Priority Data

May 15, 1996 [JP] Japan ..... 8-120627

[51] Int. Cl.[6] ..... H01J 49/04

[52] U.S. Cl. ..... 250/288

[58] Field of Search ..... 250/288

[56] References Cited

U.S. PATENT DOCUMENTS

| | | | |
|---|---|---|---|
| 5,051,584 | 9/1991 | Gray et al. | 250/288 |
| 5,559,337 | 9/1996 | Ito et al. | 250/288 |
| 5,565,679 | 10/1996 | Tanner et al. | 250/288 |

*Primary Examiner*—Jack I. Berman
*Attorney, Agent, or Firm*—Loeb & Loeb LLP

[57] ABSTRACT

A plasma ion source mass analyzer composed of: a plasma ion source for ionizing a sample in a plasma; a vacuum vessel; a sampling cone and a schema cone each having a front end provided with a hole for passage into the vacuum vessel of a beam of ions generated in the plasma, the holes in the cones defining an inlet axis of the beam; a mass filter disposed in the vacuum vessel for mass-separating ions in the beam; an ion lens disposed in the vacuum vessel to lead ions in the beam to the mass filter, the ion lens having an entrance which subtends a solid angle relative to a point in the hole of the schema cone; an extraction electrode disposed in the vacuum vessel between the schema cone and the ion lens to lead ions passing through the schema cone to the ion lens; a gate valve disposed between the extraction electrode and the ion lens; a detector set in the vacuum vessel to detect ions which pass through the mass filter; and a diaphragm mounted within the extraction electrode for narrowing the beam which passes through the hole in the schema cone to cause the beam to subtend a solid angle, relative to the point in the hole of the schema cone, which is less than the solid angle subtended by the entrance of the ion lens.

2 Claims, 3 Drawing Sheets

PLASMA ION SOURCE MASS ANALYZER

BACKGROUND OF THE INVENTION

The present invention relates to a plasma ion source mass analyzer for identifying and quantifying minor impurities in a sample. The plasma ion source mass analyzer includes an inductive-coupling plasma mass analyzer (referred to as an ICP-MS) and a microwave inductive plasma mass analyzer (referred to as an IP-MS).

A structure of the prior art is described below with reference to FIG. 2, which shows a plasma generator 1 producing a plasma 2. The plasma generator 1 can be composed of the inductive coupling plasma generator described in, for example, "Foundation and Application of ICP Spectral Analysis" (written by Haraguchi), KODANSHA SCIENTIFIC or the inductive coupling plasma generator disclosed in, for example, Japanese Patent Laid-Open No. 309300/1989. A sample to be analyzed (not illustrated) is introduced into the plasma 2 maintained by the plasma generator 1, where the sample is ionized. Ionized sample material is drawn through a hole in the apex of a sampling cone 3 by a vacuum created by a first vacuum pump 5, and then through a hole in the apex of a schema cone 4. The sampling cone 3 has a conical shape and the hole in its apex has a diameter of 0.8 to 1.2 mm. The schema cone 4 has a conical shape and the hole in its apex has a diameter of 0.3 to 0.6 mm. A sampling interface is formed by the sampling cone 3 and the schema cone 4. The region between the sampling cone 3 and the schema cone 4 is exhausted up to approx. 1 Torr by the first vacuum pump 5 (generally, a rotary pump is used) during analysis.

The structure shown in FIG. 2 further includes a vacuum vessel 6, an ion lens 7, a mass filter 8, a detector 9, a second vacuum pump 10, a third vacuum pump 11, and an extraction electrode 12. The inside of the vacuum vessel 6 is exhausted by the second vacuum pump 10 and the third vacuum pump 11, which is kept at approx. $10^{-4}$ Torr in an enclosure in which the ion lens 7 is set and at approx. $10^{-6}$ Torr in an enclosure in which the detector 9 is set. Each of the second vacuum pump 10 and the third vacuum pump 11 is generally a turbo-molecular pump or an oil diffusion pump.

The sample ionized by the plasma 2 enters the ion lens 7 together with light from the plasma 2 after passing through the holes of the sampling cone 3 and the schema cone 4, and through the extraction electrode 12. An extraction voltage is applied to the extraction electrode 12 to extract the ions passing through the schema cone 4 toward the ion lens 7 to form the ions into an ion beam 25, shown in FIG. 1. The extraction electrode 12 has a cylindrical shape or a conical shape with a hole at its front end. The conical extraction electrode 12 is arranged so that its vertex side is directed toward the schema cone 4 side. Then, the holes of the sampling cone 3, schema cone 4, and extraction electrode 12 are located on the same axis.

The ion lens 7 leads only the ions among incoming components to the mass filter 8. The mass filter 8 passes only ions having a predetermined mass and uses, for example, a quadru-pole mass analyzer. The detector 9 detects the ions passing through the mass filter 8 and sends the detection result to a data processing section (not illustrated) as electric signals. For example, the detector 9 uses a CHANNEL TRON made by GALILEO Inc. The data processing section calculates the mass of ions according to the setting of the mass filter 8 when detected by the detector 9 to identify the type of ion and calculates the identified ions, that is, the concentration of the impurities in the sample in accordance with the detection intensity of the detector 9.

A gate valve 26 is disposed behind schema cone 4 and extraction electrode 12. The gate valve 26 opens to form a space through which ions pass at the time of measurement. Moreover, at the time of no measurement, the gate valve 26 closes to cut off the atmospheric pressure so as to keep the inside of the vacuum vessel 6 at the desired vacuum level.

Then, details of the fact that the ion beam 25 reaches a mass filter after passing through the schema cone 4 are described below with reference to FIG. 3. FIG. 3 shows a sampling interface axis 13; electrodes 14*a*, 14*b*, and 14*c* of a convergent lens 14; deflecting systems 15*a* and 15*b* a mask 16 having an aperture forming an entrance window for mass filter 8, and a mass filter axis 17. The ion lens 7 comprises the electrostatic lens 14, deflecting systems 15*a* and 15*b*, and the mask 16.

The sampling interface axis 13 is coaxial with the centers of the holes in the sampling cone 3, schema cone 4, and extraction electrode 12 and the beam of ions (ion beam 25) passing through the hole of the schema cone 4 enters the ion lens along the sampling interface axis 13. The convergent lens 14 comprises the electrodes 14*a*, 14*b*, and 14*c* and has a flat shape and a hole through which the sampling interface axis 13 passes. By applying a proper voltage to the electrodes 14*a*, 14*b*, and 14*c* of the convergent lens 14, the ion beam is converged. This type of the convergent lens 14 is referred to as an Einzel lens.

The mass filter axis 17 corresponds to the axis of the entrance window of the mass filter 8. Axis 17 is oriented in parallel with the sampling interface axis 13 with a lateral offset, perpendicular to the axes, of approximately 10 mm. The mask 16 has a flat shape and the aperture in mask 16 encloses the mass filter axis 17 and supplies the beam of ions with a proper energy to the mass filter 8 when a proper voltage is applied. Not only one aperture mask 16 is used but also a plurality of aperture masks 16 may be used.

Each of the deflecting systems 15*a* and 15*b* comprises a parallel-flat-plate deflector. Moreover, the deflecting systems 15*a* and 15*b* shift the beam of the ions entering along the sampling interface axis 13 to the mass filter axis 17.

As described above, the ion lens 7 thus constituted leads the beam of the ions to be detected to the mass filter 8 and, moreover, prevents the light of the plasma 2, which could affect the detector 9 as background noise, from reaching the mass filter 8 by controlling the light so that it goes straight on and collides with the mask 16.

However, the following problems occur because neutral components which cannot be ionized by the plasma 2 are present as objects which pass through the hole of the schema cone 4 in addition to the above described ions and light of the plasma 2. After the neutral components pass through the hole of the schema cone 4, they go straight on with a certain angular distribution, collide with the vicinity of the hole of the electrode 14*a* of the convergent lens 14 in the ion lens 7 or the aperture in mask 16, and attach to it as a film. Most of the neutral components are components of the sample and the film attaching to the mask 16 does not have electric conductivity in most cases. Moreover, the film is electrified and the potential of the surface of the film becomes unstable. That is, when the film attaches to a portion, the electric field near the portion becomes unstable, the track of the beam of the ions to be detected becomes undetermined, and, as a result, stable measurement cannot be made. In the case of the prior art, troublesome operations must be performed in that evacuation is stopped to take out an ion lens and disassemble and clean the lens when the bad influence of the film becomes noticeable. Moreover, to perform these operations, an analyzer must be stopped for a half day or longer and, thereby, a loss of time occurs.

BRIEF SUMMARY OF THE INVENTION

It is a primary object of the present invention to eliminate the above problems and to this end, the invention is embodied in a plasma ion source mass analyzer comprising a plasma ion source for ionizing a sample in plasma, a sampling cone and schema cone with holes at their front ends to lead generated ions into a vacuum vessel, an ion lens set in the vacuum vessel to lead the ions to a mass filter, an extraction electrode set between the schema cone and the ion lens to lead the ions passing through the schema cone to the ion lens, a gate valve set between the extraction electrode and the ion lens, a mass filter set in the vacuum vessel to mass-separate the ions, and a detector set in the vacuum vessel to detect the ions passing through the mass filter; in which a diaphragm is set to the middle of the extraction electrode and a solid angle estimated by the schema cone point is made smaller than the solid angle of the entrance of the ion lens.

Moreover, the present invention provides a plasma ion source mass analyzer in which the axis of the mass filter is angularly offset by 90° from the axes of the sampling cone, the schema cone, and the extraction electrode, the ion lens is provided with a 90-degree deflecting system for deflecting the beam of the ions up to 90° by an electrostatic quadrupole field, and the 90-degree deflecting system opens at the facing side of the schema cone.

In a plasma ion source mass analyzer of the present invention, the ions of a sample to be analyzed pass through a schema cone and thereafter pass through an extraction electrode and an ion lens and enter a mass filter where the ions are mass-separated and detected. However, components deviated from the center of a track among neutral components which cannot be ionized by the light of plasma and the plasma are cut off by a diaphragm set to the middle of the extraction electrode. Therefore, a film which could cause electrification around the entrance opening of the ion lens is not formed. Moreover, the components near the center of the track pass through the ion lens and go outside from the opening at the facing side of the schema cone. Therefore, the light of the plasma serving as background noises does not reach a detector through a mass filter or a film is not formed which causes electrification because the neutral components collide with the ion lens. Therefore, a film causing electrification is formed only in the vicinity of the diaphragm set to the middle of the extraction electrode after the schema cone. The extraction electrode is located at the schema cone side of a gate valve. Therefore, it is possible to easily take out and clean the extraction electrode while closing the gate valve and keeping a vacuum vessel with the ion lens and the mass filter set in it at a high vacuum state.

The inside diameter of the diaphragm is smaller than that of the ion beam introduction port of the extraction electrode and therefore the diaphragm has an effect for narrowing an ion beam. Though the position of the diaphragm is deviated from the ion beam introduction port toward the ion beam emission port of the extraction electrode, it is also possible to set the diaphragm to the ion beam emission port of the extraction electrode. When the inside diameter of the extraction electrode is decreased, position adjustment with the extraction electrode becomes difficult and, moreover, it is necessary to narrow the gap between the schema cone and the extraction electrode in order to extract more ions from an electric field formed by the extraction electrode and pass them.

DETAILED DESCRIPTION OF THE INVENTION

An embodiment of the present invention is described below in detail with reference to FIG. 1.

Figure 1:
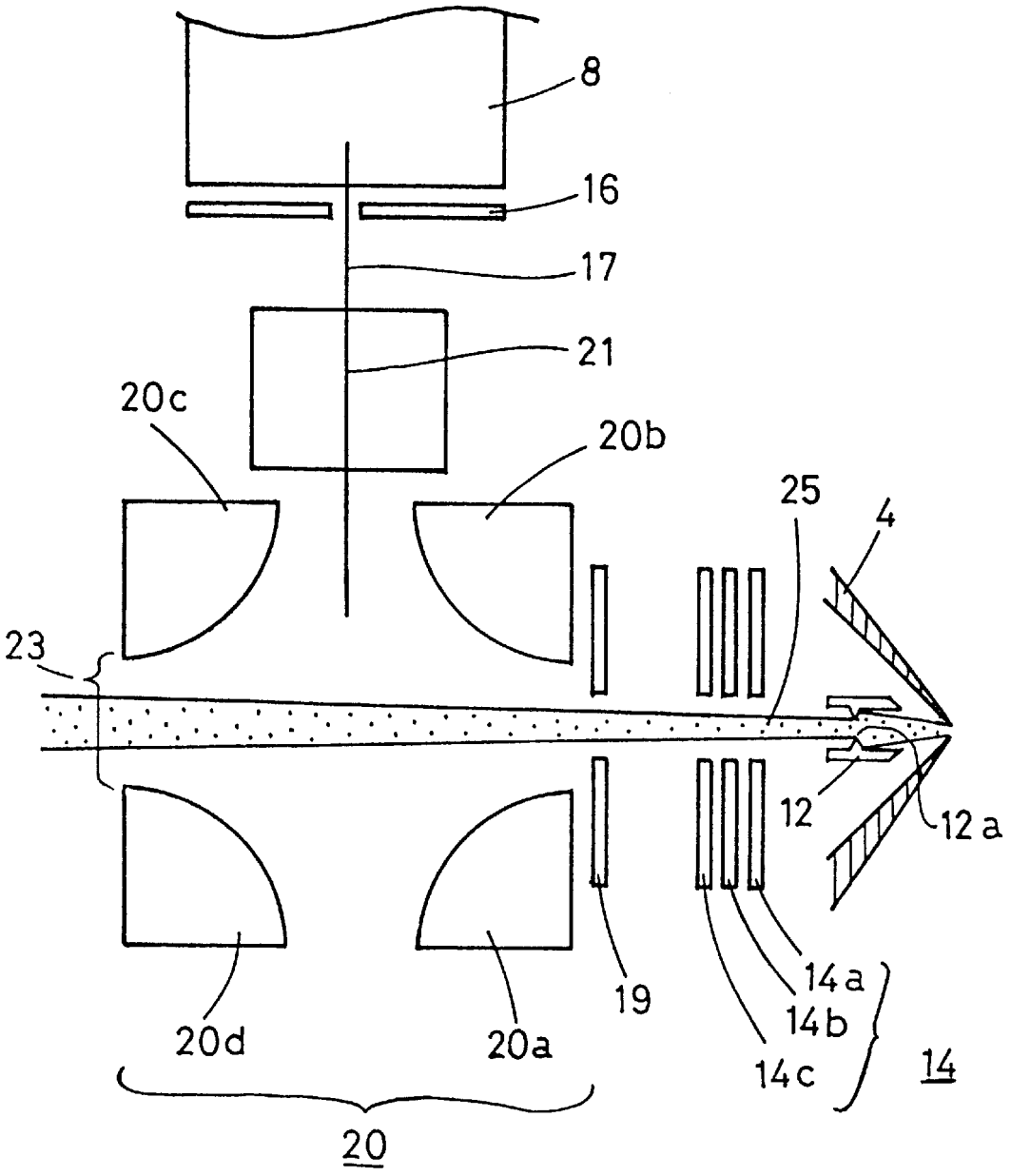
FIG. 1 is a cross-sectional view illustrating a preferred embodiment of the present invention.

FIG. 1 shows a schema cone 4, a mass filter 8, a mask 16 having an aperture forming an entrance window for mass filter 8, and a mass filter axis 17. These are described in the section of "Description of the Prior Art". An extraction electrode 12 which has a round annular shape is disposed behind schema cone 4. Extraction electrode 12 has a longitudinal axis aligned with the center of the hole in schema cone 4. Extraction electrode 12 includes a diaphragm 12*a* disposed on the inside surface of, and between the ends of, electrode 12. The diaphragm 12*a* is set to the inner surface of the extraction electrode 12 and its inside diameter is set so that the solid angle of the extraction electrode 12 estimated from the schema cone 4 point is smaller than that of the entrance opening of the convergent lens 14. With regard to the inside diameter of the extraction electrode 12, excluding the diaphragm 12*a*, the solid angle of the extraction electrode 12 estimated from the schema cone 4 is larger than that of the entrance opening of the convergent lens 14 because of an electric field formed by the extraction electrode 12. Moreover, the position of the diaphragm 12*a* is set to the emission port side (exit side) of the ion beam 25 from the center in the axial direction of the inside diameter of the extraction electrode 12. This is because the solid angle of the ion beam 25 would increase if the diaphragm 12*a* were placed at the end of electrode 12 which faces schema cone 4.

Convergent lens 14 is constituted by electrodes 14*a* , 14*b* and 14*c*. Behind convergent lens 14 there are disposed a mask 19 provided with an entrance aperture for a quadrupole deflecting system 20 composed of electrodes 20*a*, 20*b*, 20*c* and 20*d*. A correction electrode 21 is disposed between the outlet side of quadru-pole deflecting system 20 and the entrance mask 16 of mass filter 8. The convergent lens 14, entrance aperture 19, quadru-pole electrode 20, and correction electrode 21 together constitute an ion lens. A hole centering around a sampling interface axis (obtained by extending the centers of the holes of the schema cone 4 and the extraction electrode 12; not illustrated) is opened on the convergent electrode 14 to form an Einzel lens. By applying a proper voltage to the electrodes 14*a* , 14*b*, and 14*c* of the convergent lens 14, it is possible to adjust the focal distance of the beam of the ions incoming along the sampling interface axis. In this case, though the solid angle of the electrode 14*a* estimated from the hole at the front end of the schema cone 4 is 0.01 to 0.02 steradian, the solid angle of the diaphragm 12*a* estimated from the hole at the front end of the schema cone 4 is approx. ½ the solid angle of the electrode 14*a*. Moreover, a gate valve (not illustrated) is set between the extraction electrode 12 and the ion lens.

The electrodes 20*a*, 20*b*, 20*c*, and 20*d* of the quadru-pole deflecting system 20 are arranged as if vertically dividing a cylinder into four parts and arranging the four parts in parallel with their curved surfaces facing inwardly toward each other. The sampling interface axis passes mid-way between the electrodes 20*a* and 20*b* of the quadru-pole system 20 and mid-way between the electrodes 20*c* and 20*d*. That is, the gap between the electrodes 20*c* and 20*d* of the quadruple-pole system 20 serves as an opening 23 which faces away from the schema cone 4. Moreover, the mass filter axis 17 passes mid-way between the electrodes 20*a* and 20*d* of the quadru-pole system 20 and mid-way between the electrodes 20*b* and 20*c* of the system 20 and is inclined by 90° from the sampling interface axis. The electrodes 20*a*, 20*b*, 20*c*, and 20*d* of the quadru-pole system 20 constitute a 90-degree deflecting system. Moreover, a quadru-pole field is formed inside by assuming the voltages to be applied to the electrodes 20*a*, 20*b*, 20*c*, and 20*d* of the quadru-pole system 20 to be V20*a*, V20*b*, V20*c*, and V20*d*, respectively, setting the voltages at V20*a*=V20*c* and V20*b*=V20*d*, and applying these voltages to the electrodes 20*a*, 20*b*, 20*c*, and 20*d*, respectively. Though it is ideal that the curved inner surfaces of the quadru-pole electrode have the form of rectangular hyperbolic curves, it is also possible to approximate the curved surfaces by a cylindrical-surface electrodes like the case of this embodiment.

When assuming the average of the voltages applied to the electrodes 20*a*, 20*b*, 20*c*, and 20*d* of the quadruple-pole electrode 20 as Vav, and applying approx. 0.2 Vav to the electrodes 20*a* and 20*c* and approx. 1.8 Vav to the electrodes 20*b* and 20*d*, the beam of the ions incoming to the quadru-pole field along the sampling interface axis 13 is deflected by 90° and emitted along the mass filter axis 17.

The correction electrode 21 comprises one pair to four pairs of parallel flat electrodes and it is centered on the mass filter axis 17. By applying a correction voltage to each electrode of the correction electrode 21, it is possible to adjust the position and shape of the ion beam.

Then, the beam of ions and the tracks of light and neutral components are described below. The ion beam is extracted from the schema cone 4 by the extraction electrode 12 like a beam, converged by an Einzel lens so as to focus at the vicinity of the entrance of the mass filter 8, deflected by a 90-degree deflecting system, corrected by the correction electrode 21 in position and shape, and enters the mass filter 8 through the aperture in mask 16. However, because neutral components which cannot be ionized by the light of the plasma and in the plasma do not receive any electrostatic force, they expand with a distribution about the sampling interface axis after passing through the schema cone 4. In FIG. 1 the shape of the diverging ion beam, light, and neutral components is shown at 25. Moreover, because components that are offset from the center of the beam are cut off by the aperture 12*a* set to the middle of the extraction electrode, they do not form a film causing electrification around the holes of the Einzel lens. Because the inside diameter of the diaphragm 12*a* is smaller than that of the ion beam introduction port of the extraction electrode 12, the diaphragm 12*a* has the effect of narrowing the ion beam. Though the position of the diaphragm 12*a* is spaced from the ion beam introduction port of the extraction electrode 12 toward the ion beam emission, or outlet, port of the extraction electrode 12, it is also possible to set the diaphragm 12*a* at or near to the ion beam emission port of the extraction electrode 12. Moreover, neutral components near the center of the beam pass through the ion lens and go outside via the opening 23. Therefore, the light of plasma serving as background noises does not reach the detector through the mass filter and moreover, neutral components do not form a film causing electrification when they collide with the ion lens.

Therefore, the place where a film causing electrification is formed is only in the vicinity of the diaphragm set to the middle of the extraction electrode. However, the extraction electrode 12 is present at the schema cone 4 side of the gate valve. Therefore, it is possible to easily clean the inside of the vacuum vessel by taking out the extraction electrode 12 after closing the gate valve and keeping the vacuum vessel with the ion lens and mass filter set in it at a high vacuum state. As a result, it is possible to free users of the analyzer from troublesome operations of stopping evacuation and taking out an ion lens to disassemble and clean the lens and, moreover, to minimize down time.

According to the present invention, it is possible to easily clean an extraction electrode by taking out the extraction electrode while keeping the inside of a vacuum vessel at a high vacuum state even if introducing a sample to which a film causing electrification attaches into an analyzer. Moreover, it is possible to free users from troublesome operations of stopping evacuation and taking out an ion lens to disassemble and clean the lens, which are performed in the prior art and to minimize loss of time.

Figure 2:
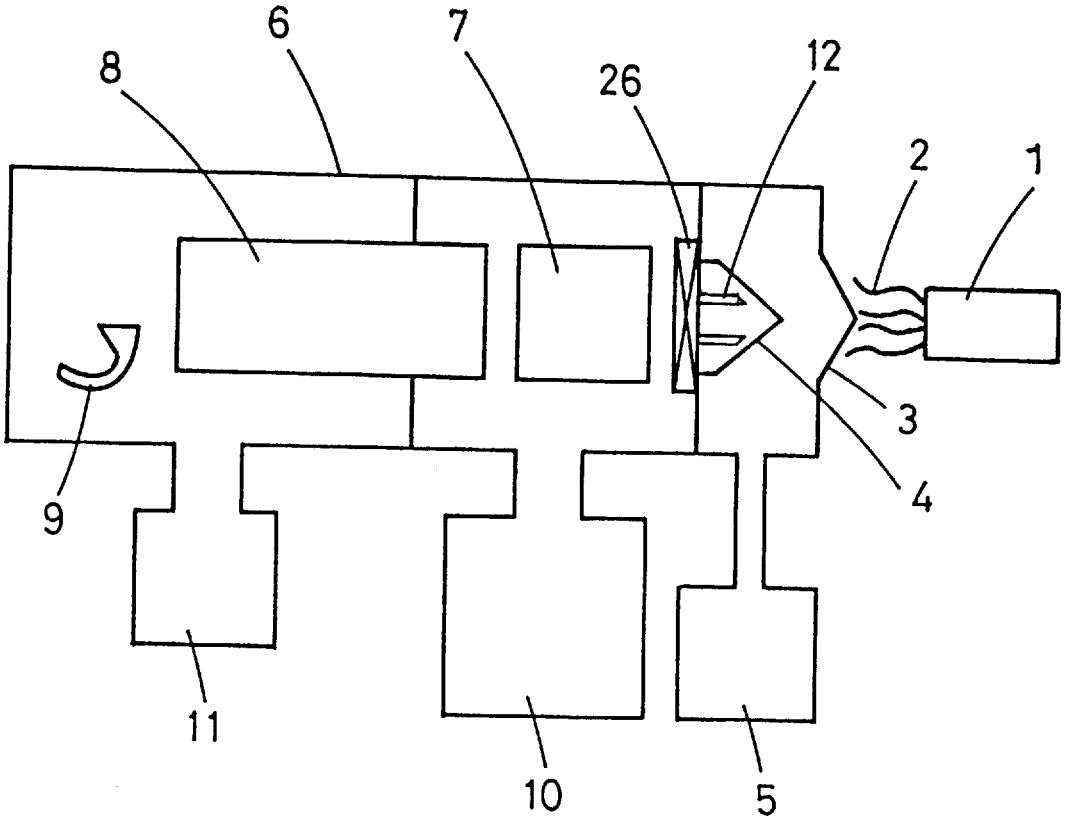
FIG. 2 PRIOR ART
FIG. 2 is a cross-sectional view showing the structure of a plasma ion source mass analyzer.
Figure 3:
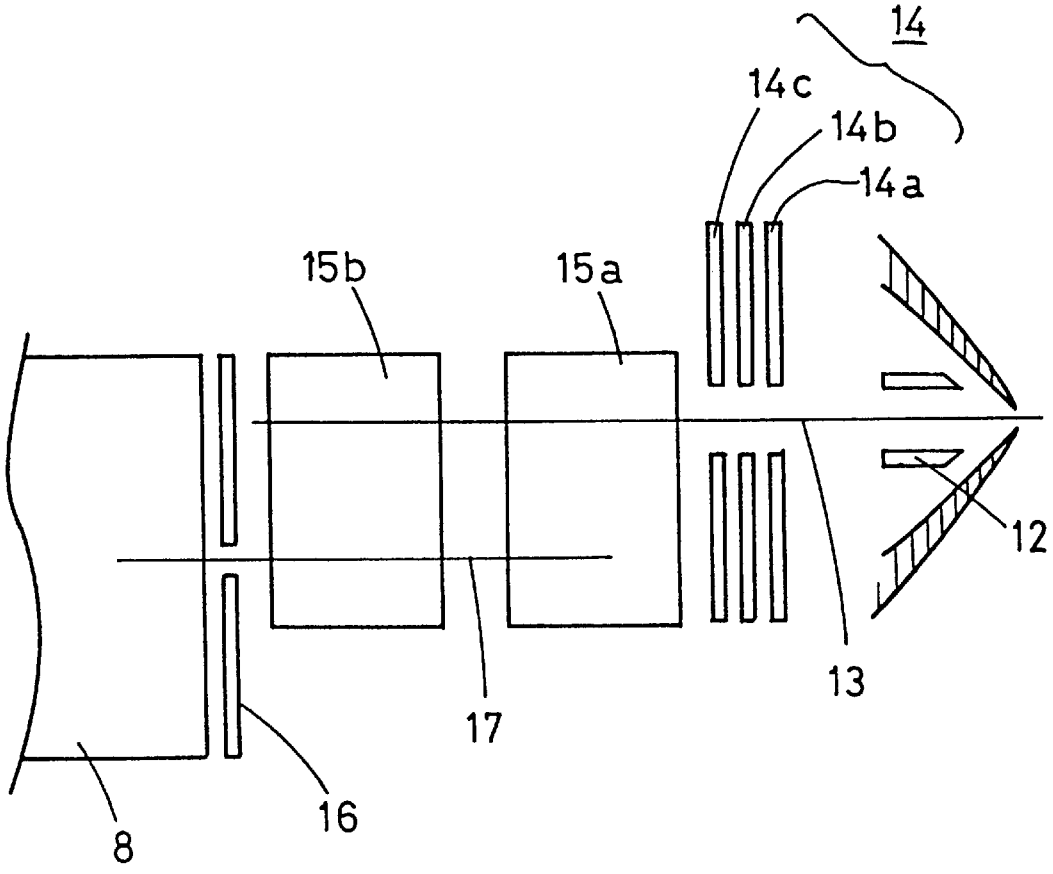
FIG. 3 PRIOR ART
FIG. 3 is a cross-sectional detail view of a portion of a prior art apparatus from a schema cone to a mass filter.

It will be understood that a complete analyzer according to the invention includes, in addition to the components shown in FIG. 1, a plasma generator, an extraction cone, a gate valve, vacuum pumps and a detector arranged to perform the functions described above with reference to FIGS. 2 and 3.

This application relates to subject matter disclosed in Japanese Application number 8-120627, filed on May 15, 1996, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A plasma ion source mass analyzer comprising:

a plasma ion source for ionizing a sample in a plasma;

a vacuum vessel;

a sampling cone and a schema cone each having a front end provided with a hole for passage into said vacuum vessel of a beam of ions generated in the plasma, the holes in said cones defining an inlet axis of the beam;

a mass filter disposed in said vacuum vessel for mass-separating ions in the beam;

an ion lens disposed in said vacuum vessel to lead ions in the beam to said mass filter, said ion lens having an entrance which subtends a solid angle relative to a point in the hole of said schema cone;

an extraction electrode disposed in said vacuum vessel between said schema cone and said ion lens to lead ions passing through said schema cone to said ion lens;

a gate valve disposed between said extraction electrode and said ion lens;

a detector set in said vacuum vessel to detect ions which pass through said mass filter; and a diaphragm mounted within said extraction electrode for narrowing the beam which passes through the hole in said schema cone to cause the beam to subtend a solid angle, relative to the point in the hole of said schema cone, which is less than the solid angle subtended by the entrance of said ion lens.

2. A plasma ion source mass analyzer according to claim 1, wherein said mass filter has an inlet axis oriented at an angle of 90° to the inlet axis of the beam, and said ion lens comprises a 90° deflecting system producing an electrostatic quadruple-pole field for deflecting the beam of ions from the inlet axis by 90°, said 90° deflecting system having an inlet opening which faces said schema cone.

* * * * *